US006360659B1

(12) United States Patent
Newman

(10) Patent No.: US 6,360,659 B1
(45) Date of Patent: Mar. 26, 2002

(54) CORNER MEMBER FOR A SCREEN PRINTING ROLLER FRAME

(76) Inventor: Don Newman, 419 Rices Mill Rd., Wyncote, PA (US) 19095

( * ) Notice: Subject to any disclaimer, the term of this patent is extended or adjusted under 35 U.S.C. 154(b) by 0 days.

(21) Appl. No.: 09/684,764

(22) Filed: Oct. 6, 2000

Related U.S. Application Data

(60) Provisional application No. 60/158,411, filed on Oct. 7, 1999.

(51) Int. Cl.[7] ..... B05C 17/06; B05C 17/08

(52) U.S. Cl. ..... 101/127.1; 101/121.1

(58) Field of Search ..... 101/127, 121.1; 38/102.91; 29/121.1

(56) References Cited

U.S. PATENT DOCUMENTS

| | | | | | |
|---|---|---|---|---|---|
| 988,331 | A | | 4/1911 | Greulich et al. | |
| 3,211,089 | A | | 10/1965 | Messerschmitt | 101/127.1 |
| 3,422,554 | A | | 1/1969 | Prinzhorn | 38/102.1 |
| 3,482,343 | A | | 12/1969 | Hamu | 38/102.5 |
| 3,485,165 | A | | 12/1969 | Hughes | 101/127.1 |
| 3,601,912 | A | | 8/1971 | Dubbs | 38/102.91 |
| 3,908,293 | A | * | 9/1975 | Newman | 38/102.91 |
| 3,914,887 | A | | 10/1975 | Newman | 38/102.8 |
| 4,345,390 | A | | 8/1982 | Newman | 38/102.91 |
| 4,430,814 | A | | 2/1984 | Wulc | 38/102.91 |
| 4,525,909 | A | * | 7/1985 | Newman | 29/121.1 |
| 5,018,442 | A | | 5/1991 | Hamu | 101/127.1 |
| 5,127,176 | A | | 7/1992 | Newman | 38/102.1 |
| 5,148,745 | A | | 9/1992 | Hamu | 101/127.1 |
| 5,163,367 | A | * | 11/1992 | Newman | 101/127 |
| 5,265,534 | A | | 11/1993 | Hamu | 101/127.1 |
| 5,365,840 | A | | 11/1994 | Newman | 101/127.1 |
| 5,377,422 | A | | 1/1995 | Newman | 33/620 |
| 5,379,691 | A | | 1/1995 | Hamu et al. | 101/127.1 |
| 5,522,148 | A | | 6/1996 | Newman | 33/620 |
| 6,098,539 | A | * | 8/2000 | Ohira et al. | 101/127.1 |

* cited by examiner

*Primary Examiner*—John S. Hilten
*Assistant Examiner*—M P Crenshaw
(74) *Attorney, Agent, or Firm*—Drinker Biddle & Reath LLP

(57) ABSTRACT

A frame for supporting the screen of a screen printing machine including elongated frame members retaining the edges of a tensioned screen and rigid connectors coupling the frame members together. The connectors have a pair of edges each defining a connecting surface for connection to an end surface of one of the frame members also defining a connecting surface. Either the connecting surfaces of the connectors or the connecting surfaces of the frame members are adapted to create an initial angular misalignment between confronting connecting surfaces during the coupling of the frame members resulting in pre-cambering of the frame members.

11 Claims, 4 Drawing Sheets

CORNER MEMBER FOR A SCREEN PRINTING ROLLER FRAME

CROSS REFERENCE TO RELATED APPLICATIONS

This application claims the benefit of U.S. Provisional Application No. 60/158,411 filed Oct. 7, 1999.

FIELD OF THE INVENTION

The present invention is directed to connecting members for coupling frame members of a screen printing machine. In particular, the present invention is directed to a connecting member which pre-cambers the frame member prior to mounting the screen.

BACKGROUND OF THE INVENTION

Screen printing machines utilize a tensioned screen of fabric or mesh mounted on a supporting frame. A squeegee forces ink or other fluid media through the screen over an area whose shape is defined by a stencil. The squeegee is moved under pressure across the screen to deflect the screen downwardly toward the substrate to provide for transfer of the fluid medium onto the substrate.

The screen of a screen printing machine is typically secured to a rectangular frame having coupled members which retain the edges of the tensioned screen. Prior art frames include frames known as "stretch and glue" frames in which a screen is adhered to a supporting frame while in a tensioned condition. Also known in the art are frames known as "roller frames" in which rollers are coupled together and rotatably supported by connecting members. Each of the rollers retains an edge of the screen for tensioning of the screen through rotation of the rollers. A locking mechanism secures the rollers to the connecting members to maintain the desired tension in a print screen. A typical roller of a roller frame includes a hollow cylindrical tube made of aluminum and having a longitudinally extending channel in which an edge of the screen is retained.

For larger frames, the coupled members of the frame can become long enough that the members may become subject to undesirable transverse deflections. Such deflections may include inwardly directed deflections resulting from loads applied to the frame by the tensioned screen. As a result of the inward deflections, the printing area of the screen may become distorted leading to loss of print area and undesirable inconsistencies during printing.

Reinforcement structures for frames to resist deflections of frame members are known in the art. For example, U.S. Pat. No. 3,908,293 to Newman, which is incorporated herein by reference, discloses a roller frame in which the rollers supporting the screen are coupled together by corner members. The roller frame includes a tensioning member extending between the corner members to camber the rollers. The tensioning members are located inwardly from the rollers at a distance from the rollers and therefore encroach towards the print area of the screen. The '293 patent teaches that the corner members are flexible so that the legs of the corner members can rotate in order to achieve the desired outward cambering of the roller. However, the necessary flexibility of the corner members also leads to warping of the frame from undesirable deflections of the corner legs out of the plane of the frame.

U.S. Pat. No. 4,345,390 to Newman, which is also incorporated herein by reference, shows a roller frame having an inwardly disposed roller support member associated with each roller. The support member is located adjacent the roller to resist inward deflection of the roller resulting for example from loading applied to the roller by a tensioned screen. The disclosed support structures are passive structures which have not been cambered prior to tensioning of a supported screen.

What is needed is a rigid connecting member for coupling elongated frame members to form a frame of a screen printing machine in which an angular misalignment between connecting surfaces of connecting members and the frame member causes a pre-cambering of the frame members during the process of coupling the frame members to form the frame. The provision of pre-cambering by the connecting members eliminates the need for additional reinforcing members. This represents weight savings and size reduction over prior art frames directed to cambering which require additional frame reinforcing members.

SUMMARY OF THE INVENTION

According to the present invention there is provided a frame for supporting the screen of a screen printing machine. The frame includes elongated frame members which retain the edges of a tensioned screen. The frame also includes rigid connectors coupling the frame members together. The connectors have a pair of edges defining connecting surfaces for connection to end surfaces of the frame members also defining connecting surfaces. Either the connecting surfaces of the connectors or the connecting surfaces of the frame members are adapted to create an angular misalignment between the connecting surfaces of the elongated frame members and rigid connectors during the coupling of the frame members. This angular misalignment forces a pre-cambering of the frame members resulting in substantial alignment between the connecting surfaces.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
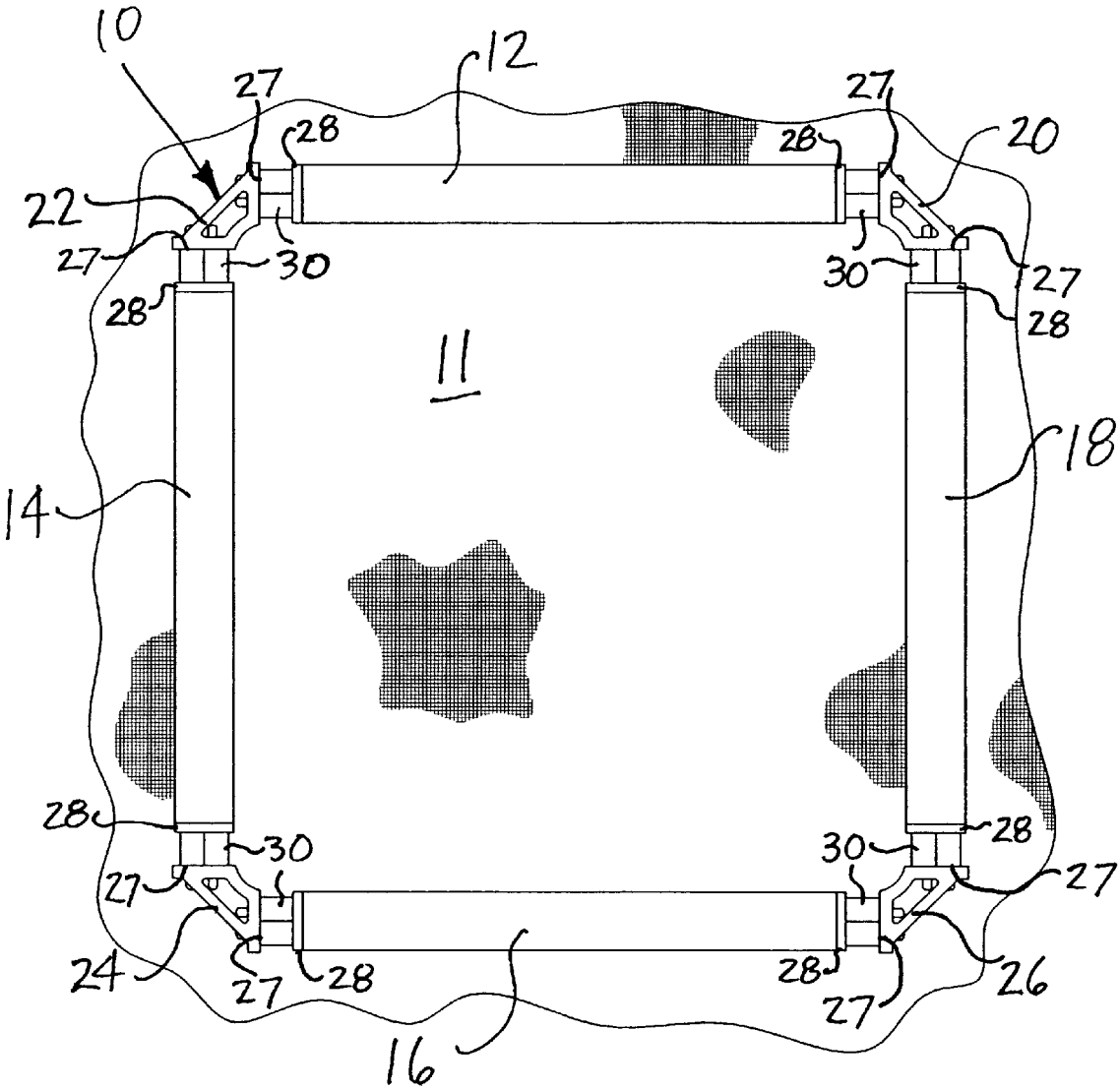
FIG. 1 shows a plan view of a roller frame according to the present invention shown supporting a tensioned screen.

In the drawings wherein like numerals identify like elements, there is shown a roller frame screen printing machine designated by the numeral 10. A screen 11, preferably of fabric or mesh, is supported on one side of the frame 10. The frame 10 has four elongated rollers 12, 14, 16 and 18 that are coupled to each other at the corners of the frame by connecting corner members 20, 22, 24 and 26. The rollers have two opposed ends, each defining a connecting surface 27. The rollers are preferably made of a non-corrosive, light weight material, such as aluminum. A nut-like element 30 forms a part of an end plug 28 for each end of the rollers 12, 14, 16 and 18 which consist of hollow cylindrical tubes. A locking groove (not shown) or other means is provided in each of the rollers to retain an edge portion of the screen 11. The locking groove may be made in accordance with U.S. Pat. No. 4,525,909. The end plugs 28 may be made in accordance with U.S. Pat. No. 5,127,176. These two patents are incorporated herein by reference.

The corner members 20, 22, 24, 26 support the rollers 12, 14, 16, 18 for rotation about their longitudinal axes. As shown in FIG. 1, roller 12 is connected to corner members 20 and 22. Roller 14 is connected to corner members 22 and 24. Roller 16 is connected to corner members 24 and 26. Finally, roller 18 is connected to corner members 26 and 20. The corner members are preferably made of a rigid light-weight material, such as aluminum, which has been molded and machined to the desired shape and size using techniques known in the art. The embodiment of the corner members 20, 22, 24 and 26 shown in the figures is illustrative only. It is contemplated that the corner members can have a variety of shapes and sizes to connect the rollers 12, 14, 16, 18 together to form the frame 10. Each corner member 20, 22, 24, 26 is preferably identical and interchangeable.

Figure 2:
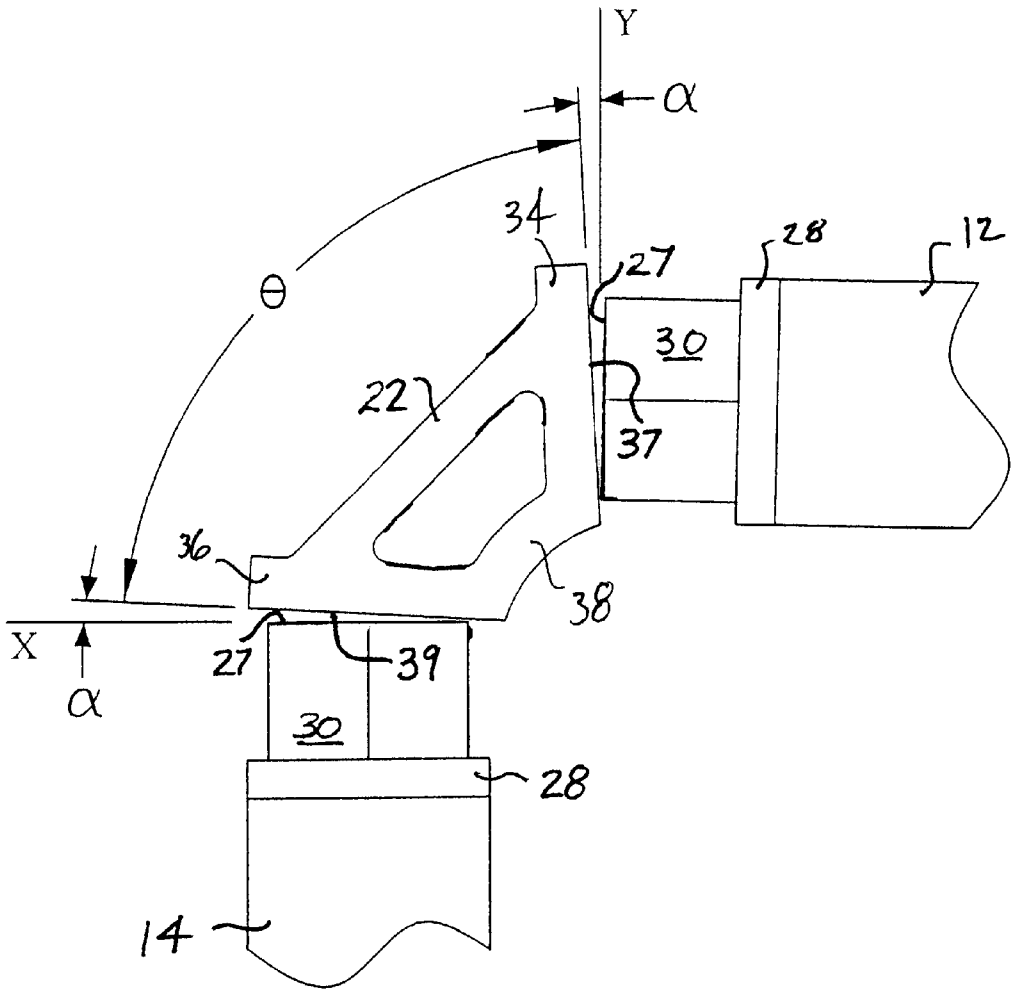
FIG. 2 shows a partial plan view of the frame of FIG. 1 during assembly.
Figure 3:
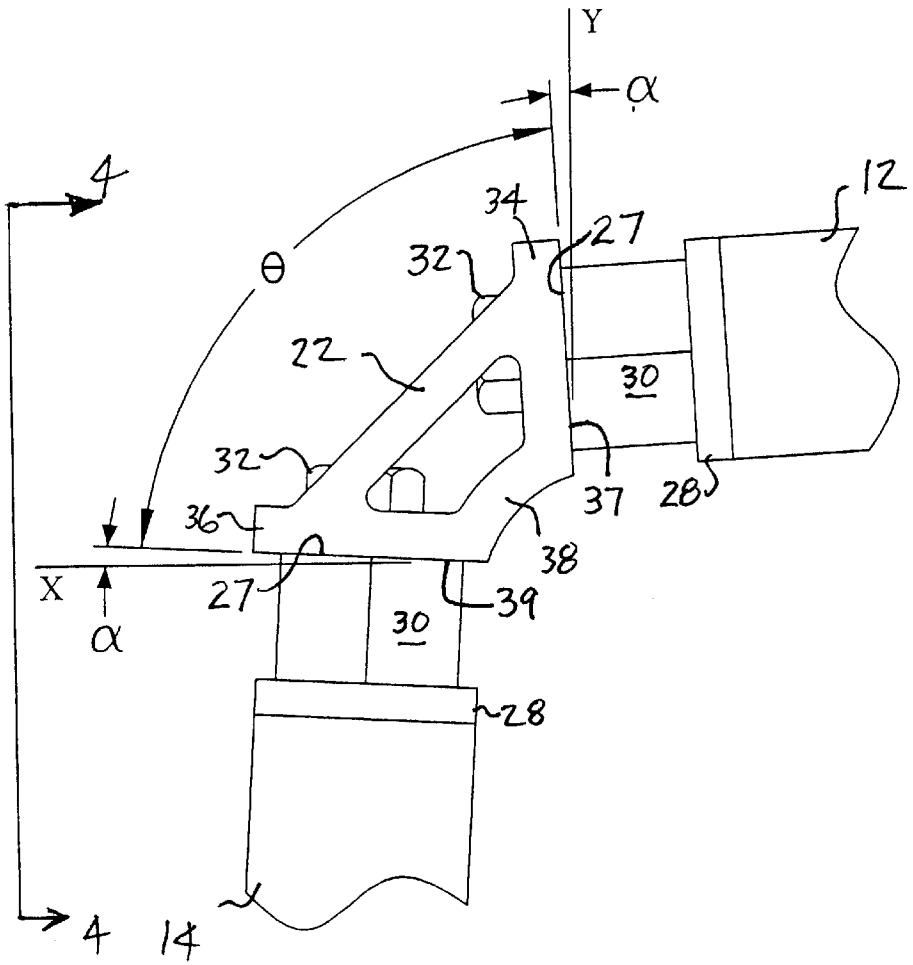
FIG. 3 shows a partial plan view of the frame of FIG. 1 after assembly.
Figure 4:
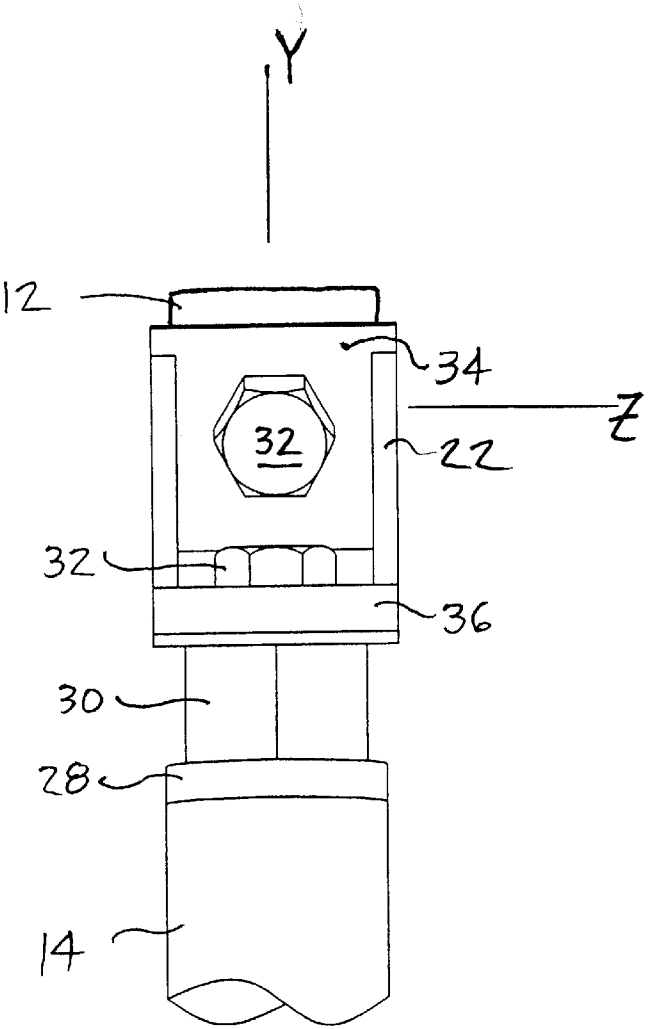
FIG. 4 shows a view taken along the lines 4—4 of FIG. 3.

Referring to FIGS. 2–4, the pre-cambering of the rollers which results from the coupling process is described as follows. During the coupling process the rollers are positioned between their associated corner members. This condition is seen in FIG. 2 in which rollers 12 and 14 are shown in position adjacent to corner member 22 prior to securement. Corner member 22 includes a first side having a roller support member 34 defining a connecting surface 37 and a second side having a roller support member 36 defining a connecting surface 39. The first side support member 34 is joined to the second side support member 36 by a web 38.

The angular orientation of the connecting surfaces 37, 39 of corner member 22 is shown relative to orthogonal X and Y axes. Corner member 20 at the opposite end of roller 12 is a mirror image of corner member 22, as viewed along the X axis. Similarly, corner member 24 at the opposite end of roller 14 is a mirror image of corner member 22, as viewed along the Y axis. The connecting surfaces 37, 39 of corner member 22 are disposed at an angle $\theta$ relative to one another. Angle $\theta$ is an oblique angle and preferably an acute angle between approximately 25 degrees and slightly less than 90 degrees. An angle $\theta$ of approximately 88 degrees is presently most preferred. Prior to engagement of bolts 32 with the end plugs 28, an angular misalignment, having a magnitude equal to $\alpha$, will exist between each of connecting surfaces 37, 39 of the corner members and the connecting surfaces 27 of the ends of the rollers which confront connecting surfaces 37, 39.

Referring to FIGS. 3 and 4, the rollers 12 and 14 are shown after the coupling process has been completed and the rollers have been pre-cambered. The end plugs 28 of rollers 12 and 14 are connected to corner member 22 by bolts 32. The first side support member 34 and the second side support member 36 have holes (not shown) through which the bolts 32 are inserted and threaded into the end plugs 28 to connect the rollers 12 and 14 to corner member 22. Preferably, a washer (not shown) is seated within a recess formed about each hole to provide a load bearing surface for the head of the bolt 32.

The engagement of bolts 32 in the end plugs 28 of the elongated rollers through the rigid corner members forces a pre-cambering of the rollers. The pre-cambering of the rollers is in the X-Y plane of FIGS. 3 and 4 in an outward direction with respect to frame 10 for the preferred acute angle $\theta$. Such pre-cambering of the rollers and the corresponding rotation of the of the connecting surfaces 27 of the rollers with respect to the rigid connectors results in substantial angular alignment between the confronting connecting surfaces of the connectors and the rollers, as illustrated in FIG. 3 in which rollers 12, 14 are shown connected to corner member 22.

In the embodied frame of the figures, the sides of the corner members have been adapted to provide for the angular misalignment with the end surfaces of the rollers. It is contemplated that the ends of the rollers can be adapted instead of, or in addition to, the sides of the corner members to create confronting connecting surfaces providing for angular misalignment during coupling according to the present invention. For example, connecting surfaces of the ends of the rollers could be oriented at an oblique angle with respect to a longitudinal axis of the roller. Coupling of such rollers between corner members having perpendicularly oriented connecting surfaces in the manner previously described would result in an initial angular misalignment between confronting connecting surfaces and a pre-cambering of the rollers upon engagement of attachment bolts 32.

In operation, the pre-camber created by the coupling of the roller 12, 14, 16, 18 to form the frame 10 may be used to at least partially counteract deflections resulting from tensioning of the screen. An edge portion of the screen 11 is first secured in the locking groove of each roller 12, 14, 16, 18 in a pre-cambered and pre-tensioned condition before the rollers are fully attached to the corner members 20, 22, 24, 26. After edge portions of the screen are secured to the rollers, the ends of the rollers 12, 14, 16, 18 are attached to the support members 34, 36 of their associated corner members to pre-camber the rollers outwardly. A wrench member or other tensioning mechanism is then engaged with the nut-like elements 30 of the end plugs 28 of the rollers. The rollers are rotated to tension the screen 11 to the desired tension. The tension created in the screen 11 will begin to pull the pre-cambered rollers 12, 14, 16, 18 inwardly toward the center of the frame 10. The resulting condition of the rollers may not be necessarily straight. Following screen tensioning, the rollers may be cambered outwardly or inwardly or may be straight. In all cases, however, the pre-cambering will serve to position the tensioned roller less inwardly than would have been the case without pre-cambering. Additionally, the pre-cambering stiffens the roller increasing the bending resistance of the roller.

Figure 5:
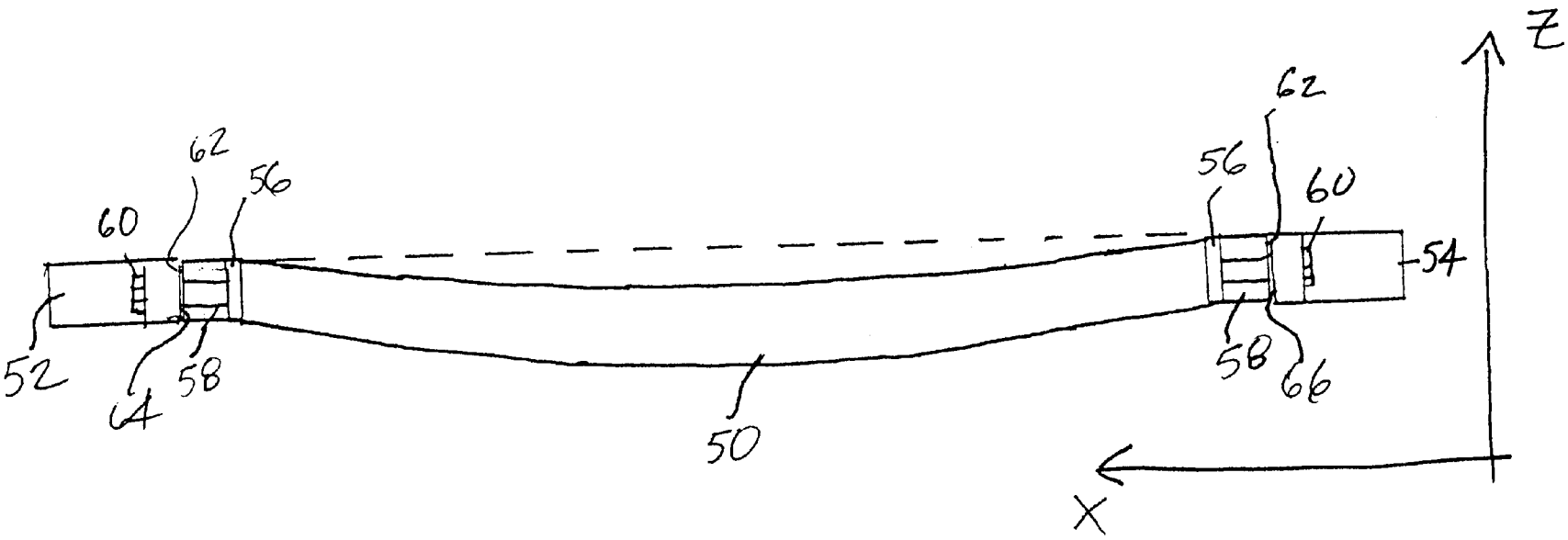
FIG. 5 is a schematic illustration showing a pre-cambering according to the present invention in a direction perpendicular to the X-Y plane of the screen.

The embodiment shown in FIGS. 2–4 has been described with reference to pre-cambering of the rollers in the X-Y plane. Referring to FIG. 5, a schematic view of a frame according to the present invention is shown in which a roller 50 is connected to corner members 52, 54. The roller 50 includes end plugs 56 having nut-like portions 58 and is secured to the corner members 52, 54 by bolts 60 in a similar manner to that described previously in regard to the rollers 12 and 14. The ends of roller 50 have connecting surfaces 62 which confront connecting surfaces 64, 66 of corner members 52, 54, respectively. In contrast to the corner members of FIGS. 1–4 which were adapted for pre-cambering in the X-Y plane, the corner members 52, 54 are adapted for angular misalignment causing a pre-cambering in the X-Z plane in a direction which is perpendicular to the plane of the print screen.

Reinforcing structures of the prior art for resisting bowing may be located inwardly or outwardly with respect to the roller. Those that are located inwardly encroach upon the printing area of the frame. The addition of reinforcing structure also represents an increase in the overall weight of the frame. The present invention, by providing for pre-cambering of the rollers by the corner members, eliminates the need for additional structure. The present invention therefore provides desirable pre-cambering without requiring additional weight and without increasing the size of the frame.

While the present invention has been described in connection with the preferred embodiments of the various figures, it is to be understood that other embodiments may be used or modifications and additions made to the described embodiments for performing the same function of the present invention without deviating therefrom. Therefore, the present invention should not be limited to any single embodiment, but rather construed in breadth and scope in accordance with the recitation of the appended claims.

I claim:

1. A frame for supporting and tensioning a printing screen for use within a screen printing machine, said frame comprising:

a plurality of elongated frame members, each of the frame members having opposite ends, each end defining a connecting surface, each frame member adapted to operably retain an edge of the printing screen; and a plurality of connectors for coupling said frame members together, the connectors having a pair of edges each defining a connecting surface for engaging the connecting surfaces at the ends of said frame members, the adjacent connecting surfaces of at least one of the connectors and frame members being in angular misalignment, said connectors being sufficiently rigid relative to the frame members such that the angular misalignment causes the coupling of said at least one frame member to said connector to pre-camber the at least one frame member upon the engagement of said connecting surfaces.

2. The frame according to claim 1 wherein said pre-cambering occurs in the plane of said frame in an outward direction with respect to said frame member.

3. The frame according to claim 1 wherein said pre-cambering occurs in a direction which is perpendicular to the plane of the frame.

4. The frame according to claim 1 wherein said plurality of elongated frame members consists of four frame members coupled together to form a generally rectangular frame, and wherein the connecting surfaces of the pair of edges of said connector are oriented at an oblique angle with respect to one another.

5. The frame according to claim 4, wherein said oblique angle is less than ninety degrees.

6. A frame for supporting a printing screen for use in screen printing, the frame comprising:

a plurality of elongated frame members having opposite ends defining planar connecting surfaces; and a plurality of connectors each located between a pair of said frame members, each of said connectors having opposite sides, each side adapted for coupling to one end of a respective frame member, each side of said connectors defining planar connecting surfaces, the connecting surfaces of said frame members engaging the connecting surfaces of said connectors during coupling, at least one of the adjacent connecting surfaces of the frame members and the connectors being in angular misalignment prior to coupling, the coupling of the frame members to the connectors forcing engagement of connecting surfaces at end of the frame member such that said frame member is cambered outwardly with respect to its length.

7. The frame according to claim 6 wherein said frame members are coupled to said connectors by bolts extending through the connecting surfaces of the sides of said connectors.

8. The frame according to claim 6 wherein each of said connectors includes at least one stiffening web extending between the opposite sides of said connector.

9. A rectangular frame having four sides joined to one another at four corners for supporting and tensioning a printing screen, the rectangular frame comprising:

elongated rollers disposed along at least three sides of the frame and having opposite ends, each roller operably retaining an edge of the printing screen and supported for rotation about its longitudinal axis for applying tension to the printing screen, each of the ends of the rollers defining a connecting surface; and corner members having first and second edges defining connecting surfaces for engagement with the connecting surfaces of the rollers, each corner member disposed between an adjacent pair of the rollers for coupling of the corner member to the pair of rollers, the connecting surfaces of at least one roller and the corresponding connecting surfaces of the adjacent corner members being angularly misaligned with respect to one another prior to coupling the roller to the corner members, the corner members being sufficiently rigid relative to the roller such that the coupling the roller to the corner members causes a pre-cambering of the roller upon engagement of the connecting surfaces of the roller to the connecting surfaces of the corner members.

10. The frame according to claim 9 wherein the each of the roller members comprises an elongated cylinder having opposite ends and end plugs received by the ends of the cylinder, and wherein the connecting surfaces of the roller members are defined by the end plugs.

11. The frame according to claim 10 wherein the roller members are coupled to the corner members by bolts extending from the end plugs, the bolts extending through the connecting surfaces of the corner members, and a nut for locking the roller to the corner member and fixing the rotative position of the roller and the corresponding tension in the printing screen.

* * * * *